US005450664A

United States Patent [19]

Babow et al.

[11] Patent Number: 5,450,664

[45] Date of Patent: Sep. 19, 1995

[54] ELECTRICAL CONNECTOR FOR MID-CABLE TERMINATION

[75] Inventors: David A. Babow, Scottsdale; Roger N. Polk, Glendale, both of Ariz.

[73] Assignee: The Whitaker Corporation, Wilmington, Del.

[21] Appl. No.: 154,338

[22] Filed: Nov. 18, 1993

[51] Int. Cl.[6] ..... H01R 4/24

[52] U.S. Cl. ..... 29/866; 439/422; 439/424

[58] Field of Search ..... 439/422, 424, 409, 410, 439/498; 29/861, 866

[56] References Cited

U.S. PATENT DOCUMENTS

| | | | |
|---|---|---|---|
| 3,247,316 | 4/1966 | Weimer, Jr. . | |
| 4,241,498 | 12/1980 | Brandeau | 29/861 |
| 4,560,224 | 12/1985 | Weisenburger | 339/97 C |
| 4,859,204 | 8/1989 | Daly et al. | 439/424 |
| 4,867,700 | 9/1989 | Kreinberg | 439/422 |
| 4,900,264 | 2/1990 | Bennett et al. | 439/391 |
| 4,915,650 | 4/1990 | Daly et al. | 439/498 |
| 4,921,442 | 5/1990 | Puerner | 439/499 |
| 4,975,080 | 12/1990 | Daly et al. | 439/498 |
| 4,975,081 | 12/1990 | Daly et al. | 439/498 |
| 5,219,303 | 6/1993 | Daly et al. | 439/422 |

*Primary Examiner*—Z. R. Bilinsky

*Attorney, Agent, or Firm*—Katherine A. Nelson; Robert J. Kapalka

[57] ABSTRACT

An initially integral terminal assembly 84; 94 useful for terminating a selected conductor 74; of a flat power cable 72 having at least two insulated conductors 74, 76 includes upper and lower plate sections 26, 50 extending in diverging directions from a common bendable hinge 46 defining a cable receiving region therebetween. Each plate section 26, 50 has at least a first portion 28, 52 corresponding to the first conductor 74 and a second portion 36, 60 associated with a second conductor 76 of the cable 72. Each portion 28, 52; 36, 60 further includes conductor terminating regions 30, 38, 54, 62 intermediate opposed upstanding side walls 42, 66 of the upper and lower plate sections 26, 50. One of the terminating regions 30, 54; 38, 62 of a selected one of the first or second portions 28, 52; 36, 60 of the plate sections 26, 50 corresponds to a selected cable conductor 74; 76 contains respective arrays of shearing means 32, 56; 40, 64 adapted to penetrate the selected conductor 74, 76 inserted therebetween upon the upper and lower plate sections 26, 50 being pressed together to shear the insulation and the selected conductor 74; 76. The terminating regions 38, 62; 30, 54 of the portions 36, 60; 28, 52 corresponding to the remaining cable conductors 76, 74 are severed from the assembly 84, 94 prior to terminating the assembly to the cable 72. Upon termination the assembly 84; 94 is electrically connected to the selected conductor 74; 76 and electrically isolated from the remaining conductors 76; 74.

10 Claims, 9 Drawing Sheets

ELECTRICAL CONNECTOR FOR MID-CABLE TERMINATION

FIELD OF THE INVENTION

The present invention relates to the field of electrical connectors and more particularly to terminals for use with flat power cables.

BACKGROUND OF THE INVENTION

U.S. Pat. Nos. 4,867,700 and 4,859,204 disclose terminals which are crimped onto a flat power cable by penetrating the insulation covering the cable's flat conductor and also shearing through the conductor at a plurality of locations. The cable is of the type entering commercial use for transmitting electrical power of for example 75 amperes nominal, and includes a flat conductor one inch wide and about 0.020 inches thick with an extruded insulated coating of about 0.004 to 0.008 inches thick over each surface with the cable having a total thickness averaging about 0.034 inches. One embodiment of terminal is stamped and formed of sheet metal and includes a pair of opposing plate sections disposed along respective major surfaces of the cable and including opposing termination regions extending transversely across the cable. Each terminating region includes a transverse array of alternating shearing wave shapes and relief recesses of equal width, the relief recesses defined by arcuate projections extending away from the cable-proximate side, and the wave shapes extending outwardly from the cable-proximate side and toward relief recesses in the opposed plate section. Each shearing wave shape has a transverse crest between parallel side edges, and the side edges of the corresponding relief recesses are associated with the wave side edges to comprise pairs of shearing edges, preferably with zero clearance. When the plate sections are pressed against a cable section disposed therebetween the crests of the wave shapes initiate cable shearing by their axially oriented side edges cutting through the cable insulation and into and through the metal conductor. The wave shapes extrude the sheared cable strips outwardly into the opposing relief recesses as the shears propagate axially along the cable for limited distances, forming a series of interlocking wave joints with the cable while exposing newly sheared edges of the cable conductor for electrical connection therewith.

Further with regard to the terminal of the above patents, fastened to the outwardly facing surface of the plate sections at the terminating regions are respective inserts of low resistance copper. The inserts have terminal-facing surfaces conforming closely to the shaped outer surface of the terminating region, with alternating wave shapes and apertures disposed outwardly of and along the terminal wave shapes and relief recesses. Upon termination the wave joints are within the insert apertures, and the sheared edges of the adjacent conductor strips and of the terminal wave shapes which formed the sheared strips are adjacent to side surfaces of the copper insert apertures. A twostep staking process is preferred: in a first step the wave joints are split axially so that portions of each arcuate shape of both terminal plate sections are forced inwardly against the adjacent sheared conductor strip of the respective wave joint to define spring fingers whose ends pin the conductor strip against the opposing wave crest to store energy in the joint; and in the second step a staking process deforms the insert between the sheared strips to deform the copper against the sheared conductor and wave shape edges, forming gas-tight, heat and vibration resistant electrical connections with the cable conductor and with the terminal, so that the inserts are electrically in series at a plurality of locations between the conductor and the terminal.

A contact section is integrally included on the terminal enabling mating with corresponding contact means of an electrical connector, or a bus bar, or a power supply terminal, for example, and can include a plurality of contact sections to distribute the power to a corresponding plurality of contact means if desired. A housing or other dielectric covering can be placed around the termination as desired, such as is disclosed in U.S. Pat. Nos. 4,900,264 and 4,921,442.

Also entering commercial acceptance is a dual-conductor flat cable, wherein a pair of parallel spaced coplanar flat conductor strips having insulation extruded therearound define power and return paths for electrical power transmission. One method has been devised for terminating an end of such dual-conductor cable, as is disclosed in U.S. Pat. No. 4,915,650, where the cable end is first slotted between the respective conductors, to define tabs insertable into slots at the rearward end of the initially integral terminal, after which the plate sections of the terminal are thereagainst, defining the wave joint termination, after which the terminal is bisected into discrete terminals associated with the respective conductors and electrically isolated from each other. U.S. Pat. No. 4,900,264 discloses a connector, terminals and method for interconnecting a pair of flat power cables together, such as to terminate an end of a tap cable along a continuous length of main cable. For dual-conductor cable a pair of terminal assemblies are used, each interconnecting one conductor of each cable to the associated conductor of the other cable aligned therewith and superposed thereover, by opposing terminal portions each containing a terminating region of shearing wave shapes on one half thereof opposing a like region of the other being crimped against the cables and thereafter staked, with the opposing terminal portions of each terminal assembly being riveted together at flange portions laterally beside the cables on each side.

In U.S. Pat. No. 4,975,081 a pair of upper and lower terminal portions is crimped against superposed dual-conductor cables on each side of the cable at a selected location along a continuous portion of at least one of the cables, for interconnecting a conductor of one with the associated conductor of the other; after interconnection of both such conductor pairs with respective terminal assemblies, a common housing is secured thereover. In one embodiment, the upper portions of both terminal assemblies are initially integral as are the lower portions of both, jointed by respective ligature pairs at the median of the cable between the conductors; after termination the ligatures are removed by tooling to define discrete terminations, with a wall of the dielectric housing providing necessary insulation therebetween by extending between the terminal assemblies and through a slot through the cable median also formed by the tooling.

In U.S. Pat. No. 5,219,303 a pair of upper and lower terminal portions coextending from a hinge and defining a cable receiving region therebetween, are used for terminating to flat cable upon the upper and lower plate sections being pressed toward each other and into flat cable. When used with single-conductor cable the assembly provides two terminations across the width of the cable. When used with dual-conductor cable in contradistinction to single-conductor cable, the connector either commons the two conductors or tooling can severe ligatures that initially join two halves of the upper terminal portion to each other and two halves of the lower terminal portion to each other. In one embodiment a contact section can extend from the hinge-remote end of either the upper or lower terminal portion and is adapted to be mounted to a terminal post for example for midcable termination. When used with dual-conductor cable, the ligatures are severed as previously described and the contact section connects only one particular conductor of the dual-conductor cable, that is the conductor at the hinge remote side of the cable. Thus, in order to electrically connect the other conductor of the dual-conductor cable, the assembly must be rotated 180 degrees such that the contact section extends from the opposite longitudinal edge of the cable, which is now the hinge remote conductor. The location of the contact sections and hinge sections of the connector will therefore alternate along the sides of the cable depending upon which conductor of the dual cable is being terminated, as shown in FIG. 4.

It is desired to provide a terminal for interconnecting selected conductors in a dual-conductor cable wherein the contact section extends along the same edge of the cable, regardless of which conductor has been terminated.

It is also desired to provide an initially integral terminal assembly which can interconnect a selected conductor of a dual conductor flat power cable at any location along a continuous length thereof and have a contact section extending from the termination for mating with a complimentary contact section of another electrical article such as a terminal post of a power supply or other conductor means.

It is additionally desired to provide an initially integral terminal assembly which can interconnect selected conductors of each of two-dual-conductor flat power cables.

SUMMARY OF THE INVENTION

The present invention is a terminal assembly for terminating an intermediate portion of a selected conductor of a flat power cable having at least two insulated conductors, each conductor being spaced from an adjacent conductor by an insulating section. The assembly includes a cable proximate terminal body member which includes opposing upper and lower plate sections extending in diverging directions from a common bendable hinge. The upper and lower plate sections are initially angularly spaced to receive a portion of a continuous length of at least one flat cable therebetween and transversely with respect to the upper and lower plate sections. Each of the upper and lower plate sections have at least a first portion corresponding to the first conductor of the cable and a second portion associated with a second conductor of the at least one cable. The first and second portions are separated by a transverse aperture associated with the insulated section between the first and second conductors. Each of the first and second portions further include conductor terminating regions intermediate opposed upstanding side walls of the upper and lower plate sections. One of the terminating regions of a selected one of the first or second portions of the upper and lower plate section corresponding to a selected conductor of the cable contains respective arrays of shearing means adapted to penetrate the selected conductor of the cable portion inserted therebetween upon the upper and lower plate sections being pressed together to shear the insulation and the selected conductor. In accordance with the present invention, the terminating regions of the others of the first and second portions corresponding to the remaining conductors of the cable are severed from the assembly prior to terminating the assembly to the cable. Upon inserting the cable between the upper and lower plate sections and pressing the plate sections together the shearing means of the selected terminating region shear the insulation of the selected conductor for electrical connection therewith and the remaining conductors remain electrically isolated from the terminated conductor.

In one embodiment the selected one of the first and second portions is adjacent the hinge. In another embodiment the selected one of the first and second portions is remote from the hinge. The terminal assembly may further include a contact section that extends from one end of the upper or lower plates and remote from the hinge.

It is an object of the present invention to provide an initially integral terminal assembly for ease of application to a selected conductor in at least one flat power cable having at least two insulated conductors.

It is another object of the present invention to provide a terminal assembly for connecting a selected conductor of a bus bar having at least two conductors extending therein to an electrical article, the terminal assembly including a contact section extending from the termination for mating with a complementary contact section of another electrical article.

It is a further object of the invention to provide a method for making a terminal assembly for termination to a selected conductor of a multi-conductor cable while remaining electrically isolated from the other conductors of the multi-conductor cable.

Embodiments of the present invention will now be described in detail with reference to the accompanying drawings.

BRIEF DESCRIPTION OF THE DRAWINGS

FIG. 1 is an isometric view of a stamped and formed blank of the prior art connector prior to bending at the integral hinge joint.

FIG. 2 is an isometric view of the connector of FIG. 1 after bending the assembly.

FIG. 3 is a side view of the connector FIG. 2 with a cable inserted between the two portions.

FIG. 4 is a dual-conductor cable having two connectors of FIG. 2 terminated thereto, one terminal electrically terminated to each of the conductors of the cable.

DETAILED DESCRIPTION OF THE DRAWINGS

Figure 1:
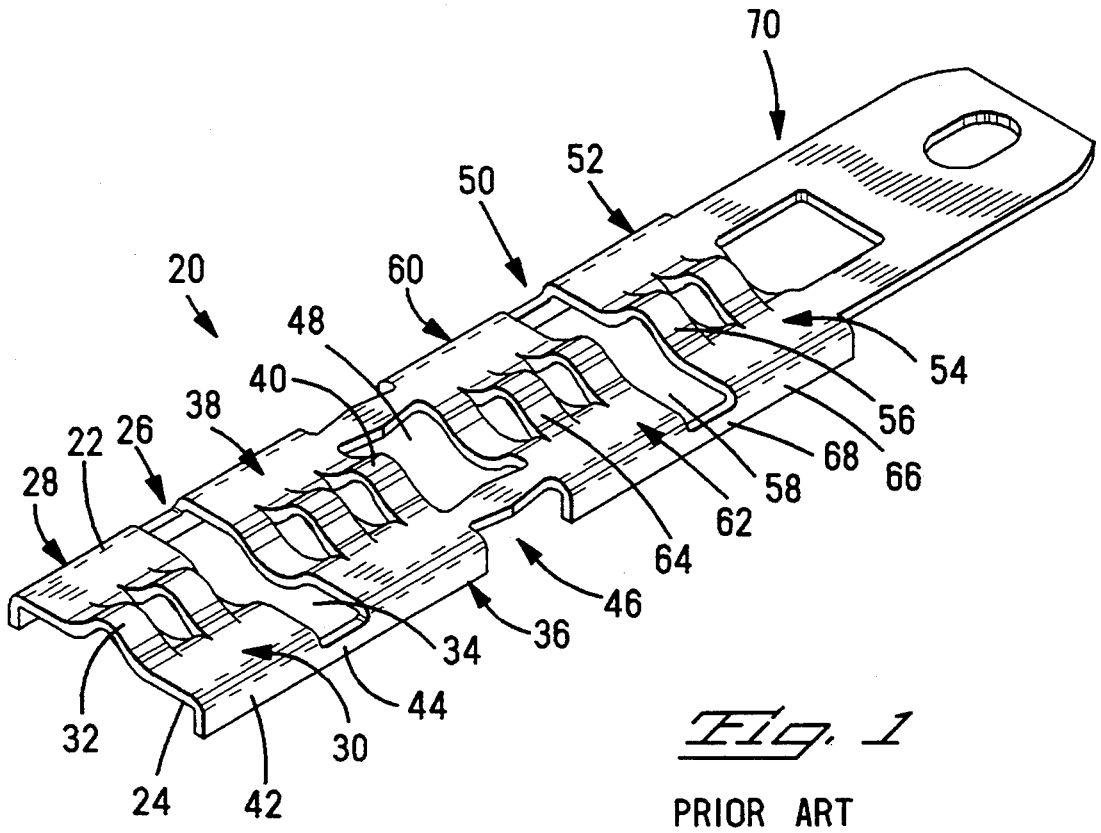
Fig. 1 PRIOR ART
FIGS. 1 through 4 illustrate a prior art terminal assembly for cable.
Figure 2:
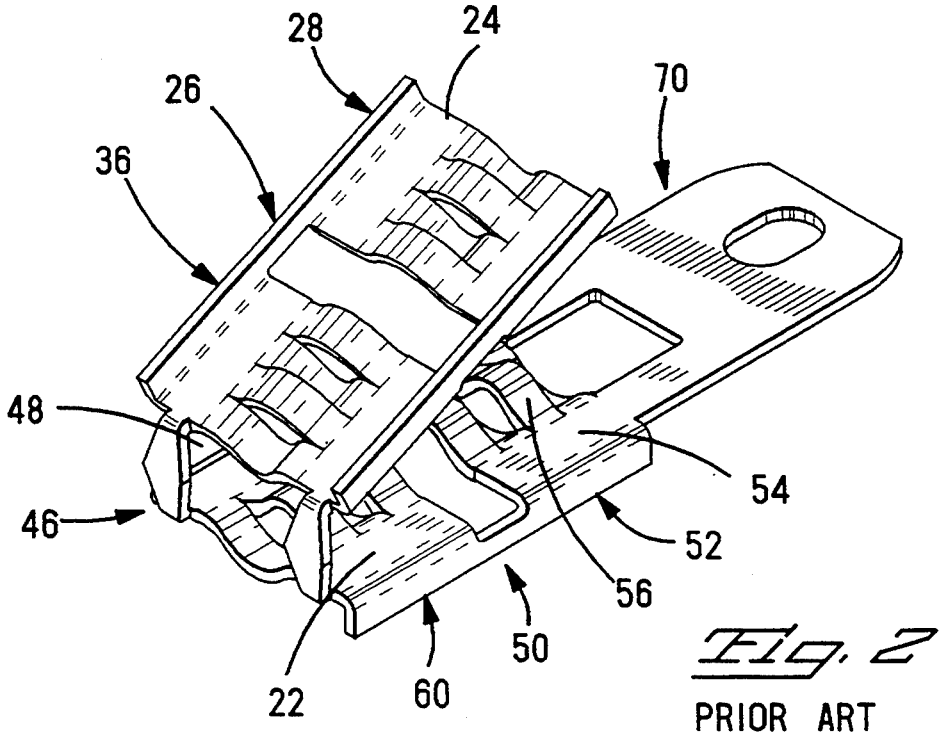
Fig. 2 PRIOR ART
Figure 3:
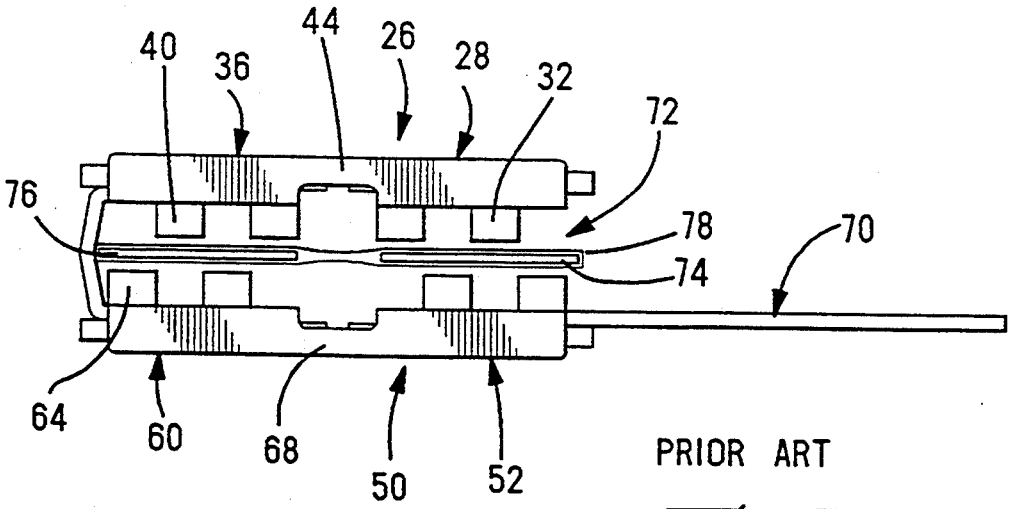
PRIOR ART Fig. 3

FIGS. 1 through 4 are representative of a prior art terminal assembly 20 used for interconnecting a single conductor cable to another electrical article, this assembly is disclosed in U.S. Pat. No. 5,219,303. Terminal assembly 20 has a cable proximate surface 22 and a cable remote surface 24 and includes an upper plate portion 26 jointed at a hinge 46 to a lower plate section. The hinged portion includes aperture 48. The upper and lower plate sections 26, 50 are adapted to be rotated and pressed together to establish electrical connections between conductors inserted therebetween. The upper plate portion 26 has a first portion 28 having a terminating region 30 and a second portion 36 having a terminating region 38. The first and second portions of upper plate 26 are separated by a transverse aperture 34. Upper plate section 26 further includes side walls 42 extending away from the cable proximate surface. Sidewalls 42 include ligature portions 44 at respective ends of aperture 34. Lower plate section 50 includes a first portion 52 having a terminating region 54 and a second portion 60 having a terminating region 62. The first and second portions of lower plate 50 are separated by a transverse aperture 58. Lower plate portion 50 further includes side wall 66 extending away from the cable proximate surface 22. Sidewalls 66 including ligature portions 68 at respective ends of aperture 58. Assembly 20 further includes a contact section 70 for electrical connection to an electrical article such as a terminal post or other means as known in the art. The upper and lower plate sections are joined by the hinged portion 46 and upon bending the terminal 20 at hinge 46 as shown in FIGS. 2 and 3, the corresponding first portions 28, 52 and the corresponding second portions 36, 60 are brought into opposing relationship.

Terminal assembly 20 is designed to be terminated to a single conductor cable as shown in FIG. 3 to a dual-conductor cable 72 having first and second isolated conductors 74, 76 surrounded by insulation 78 and having an insulated section 80 therebetween. Upon inserting cable 72 between the opposed first and second plate portions and terminating the assembly as taught in U.S. Pat. No. 5,219,303 the terminal assembly 20 is terminated to the corresponding conductors. FIG. 3 shows the terminal assembly 20 prior to termination to cable 72 such that the two conductors 74, 76 will be commoned.

First and second sections 28, 52; 36,60 of the upper and lower plate portions 26, 50 include terminating regions 30, 54; 38, 62 comprising arrays of wave shapes alternating with arcuate relief shapes surrounding a cable receiving region. The wave shapes of each of the upper and lower plate portions 26, 50 oppose the relief shapes of the other plate portions 50, 26 to be received into the relief recesses they define during termination to the cable. Such wave shape termination is disclosed in U.S. Pat. Nos. 4,867,700; 4,859,204 to shear conductor strips to expose conductor edges for gas-tight electrical connection interfaces with the terminals assembly. In terminating such portions insert members 31, 39 have wave and relief shapes adapted to be disposed between the wave and relief shapes of the cable remote surface during termination. These inserts are affixed to the assembly preferably by light staking as disclosed in U.S. Pat. No. 4,867,700.

Application of terminal assembly 20 to the cables is preformed preferably with tooling including a ram to generate compression of the upper and lower terminal portions against the cables therebetween up to for example about 3,700 pounds for termination to a single cable 0.010 inches thick to 6,000 pounds for a pair of cables each 0.020 inches thick with heavy insulation.

Figure 4:
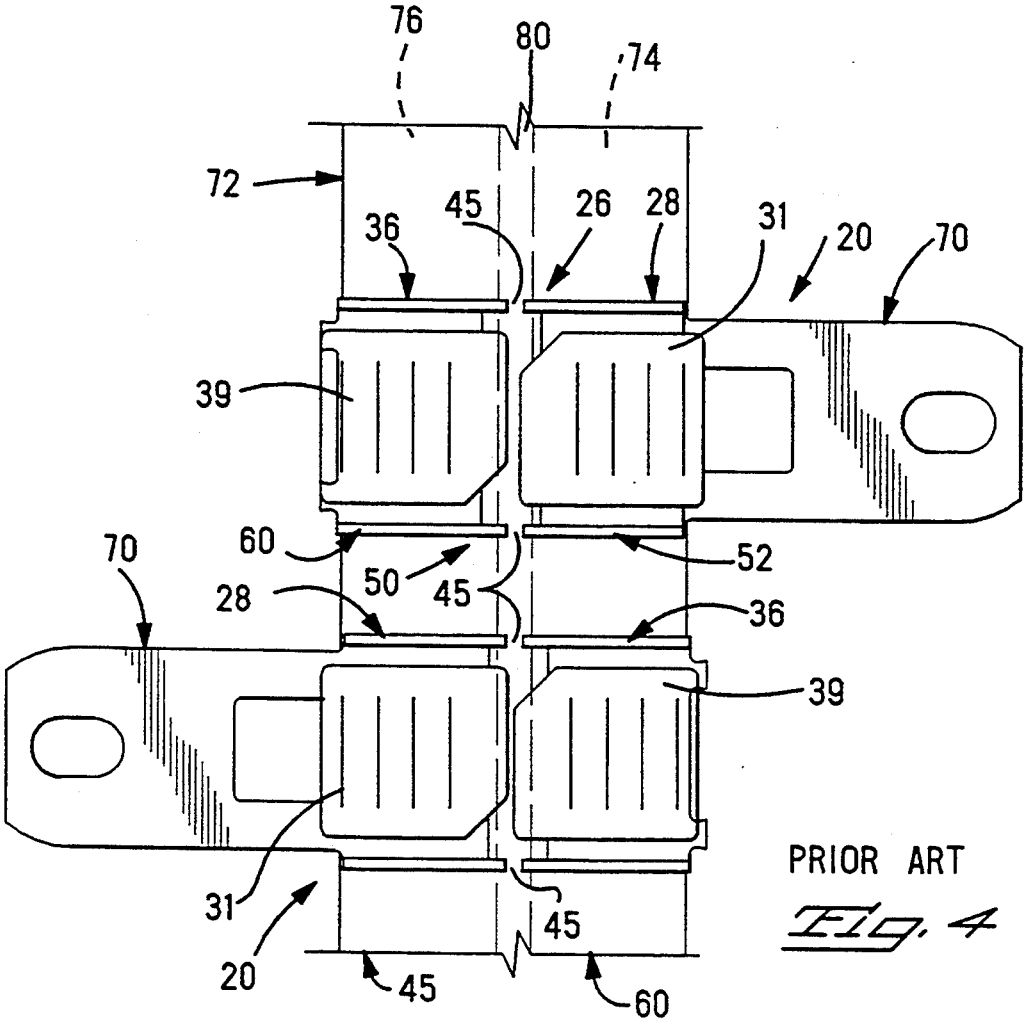
PRIOR ART Fig. 4
Figure 5:
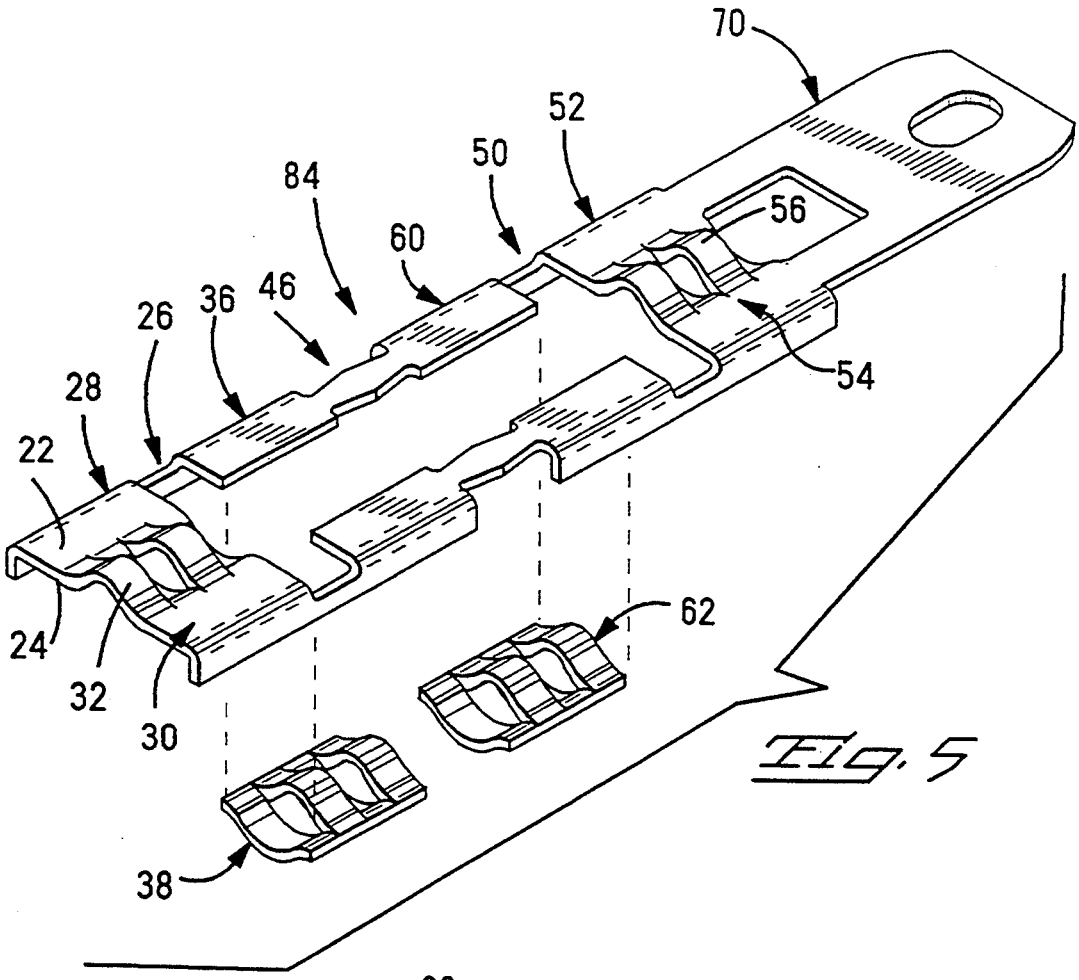
FIG. 5 is an isometric view of one embodiment of the terminal assembly of the present invention illustrating a connector blank prior to bending at the integral hinge joint.
Figure 6:
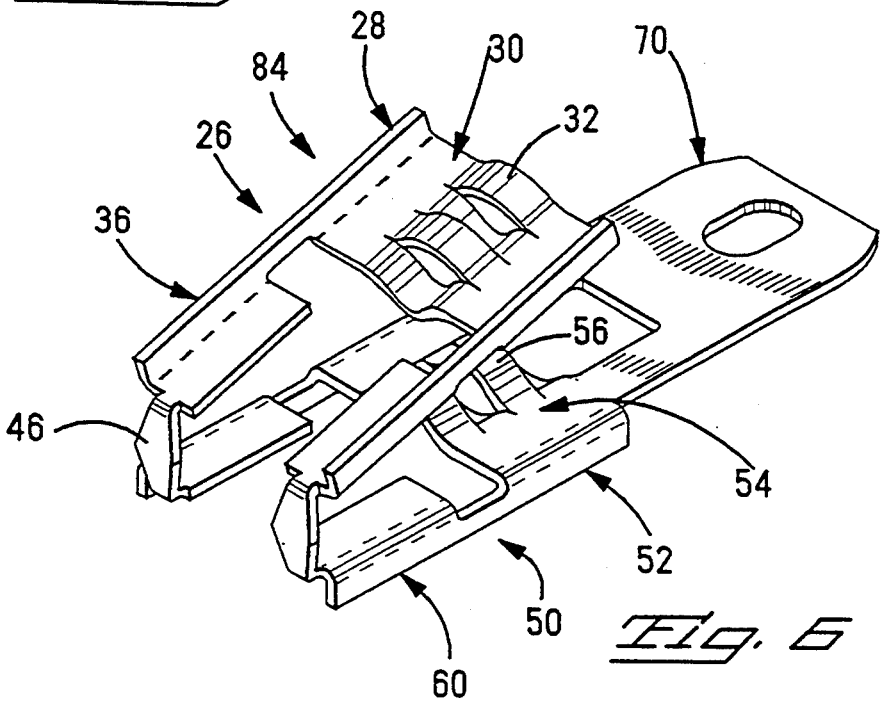
FIG. 6 is an isometric view of the assembly of FIG. 5 after bending at the hinge joint.
Figure 7:
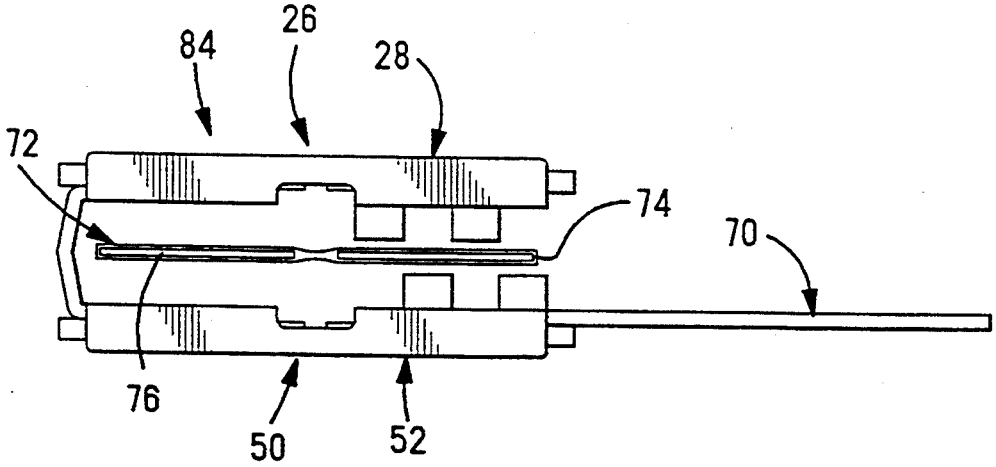
FIG. 7 is a side view of the assembly of FIG. 6 prior to termination to selected conductor of the dual-conductor cable.

FIG. 4 shows two terminal assemblies 20 terminated to a cable 72. A single assembly can be applied to the cable or cables and then severed at the respective ligatures to form a discrete terminals terminated to the two conductors of a dual-conductor cable. Thus when the assembly 20 further includes a contact section 70, only the hinge remote conductor is electrically connected thereto. This Figure also illustrates the severing at 45 of the respective ligatures 44 and ligatures 68 (not shown) by tooling such that the contact section 70 is electrically connected to conductor 74 that is the one that is remote to the hinge, as shown in the upper portion of FIG. 4. The terminal assembly 20 in the lower portion is electrically terminated to its hinge remote conductor 76. As can be seen from FIG. 4, the prior art assembly results in contact sections 70 extending from opposite edges of the dual-conductor cable 72 related to which conductor the assembly is terminated.

The present invention, on the other hand, provides a terminal assembly that can be electrically connected to a selected conductor of a dual-conductor cable. Furthermore when the assembly includes a contact section extending from a hinge remote edge, all of the contact sections extend along the same edge of a multi-conductor cable regardless of the location of the selected conductor in the cable.

Figure 8:
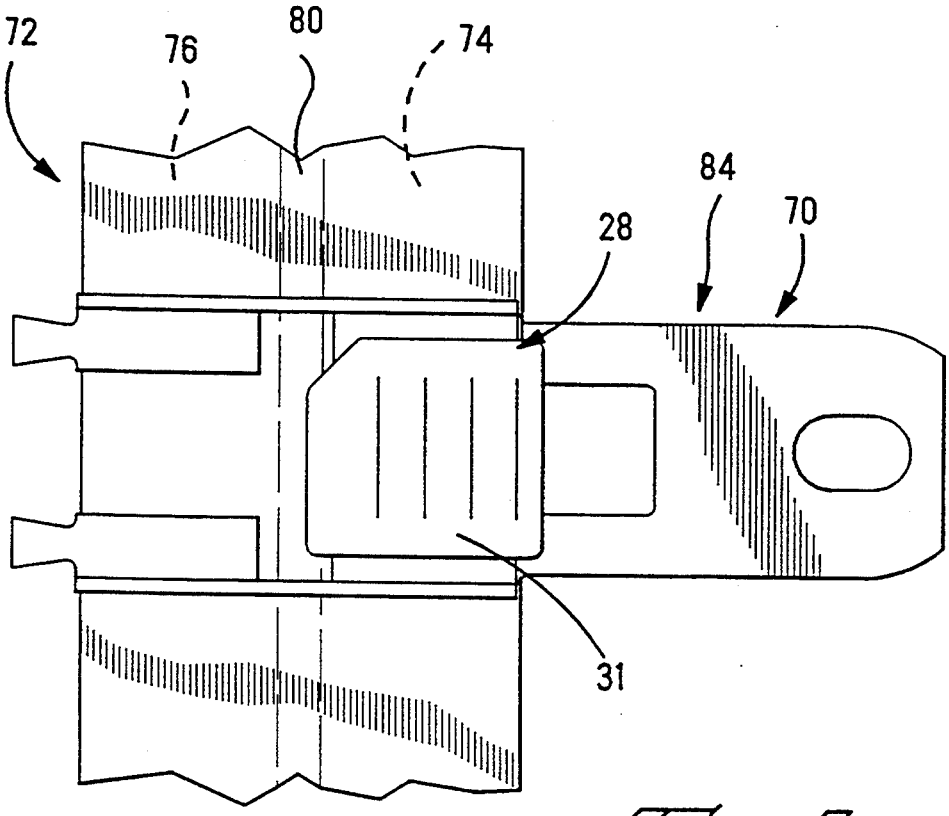
FIG. 8 is a plan view of the terminal assembly of FIG. 5 after termination the conductor.

FIGS. 5 through 8 show a first embodiment 84 of the present invention wherein the assembly 84 is adapted for termination to the hinge remote conductor of a dual-conductor cable. For purposes of illustration, the same numbers will be used for similar parts of the terminal assembly 84 and prior art assembly 20. Terminal assembly 84 has cable proximate surface 22 and a cable remote surface 24 and includes first or upper and second or lower plate sections 26 and 50 respectively joined at hinged portion 46. As seen in FIGS. 5 through 8 upper plate section 26 includes first portion 26 and second portion 36. Lower portion 50 includes first section 52 and second section 60. In this embodiment the terminating sections 38, 62 of the second portion 36 of upper plate 26 and the second portion 60 of lower plate 50 have been severed from the formed blank prior to bending the assembly 84. Upon bending the assembly at hinged portion 46 the respective first portions 28, 52 are brought into alignment in an opposed relationship such that upon inserting the dual-conductor cable 72 therebetween the terminating sections 54 and 30 are brought into alignment to be terminated to the first conductor or hinge remote conductor 74. Upon terminating the assembly 84 with the insert 31, as shown in FIG. 8, contact 70 is electrically connected to conductor 74 and only conductor 74.

Figure 9:
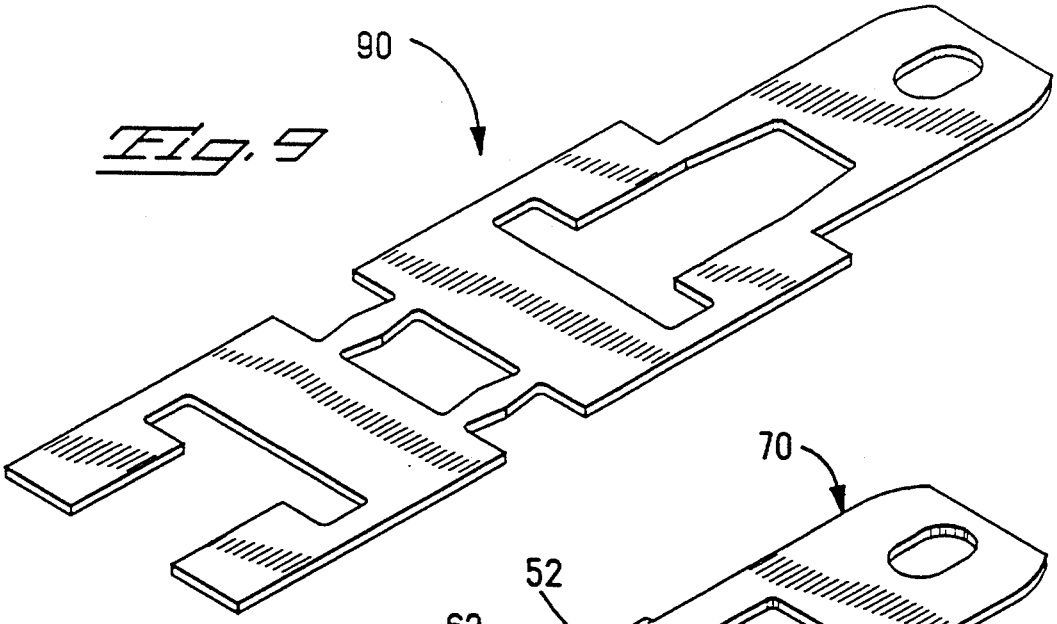
FIG. 9 is a plan view of a blank used to form a second embodiment of the present invention.
Figure 10:
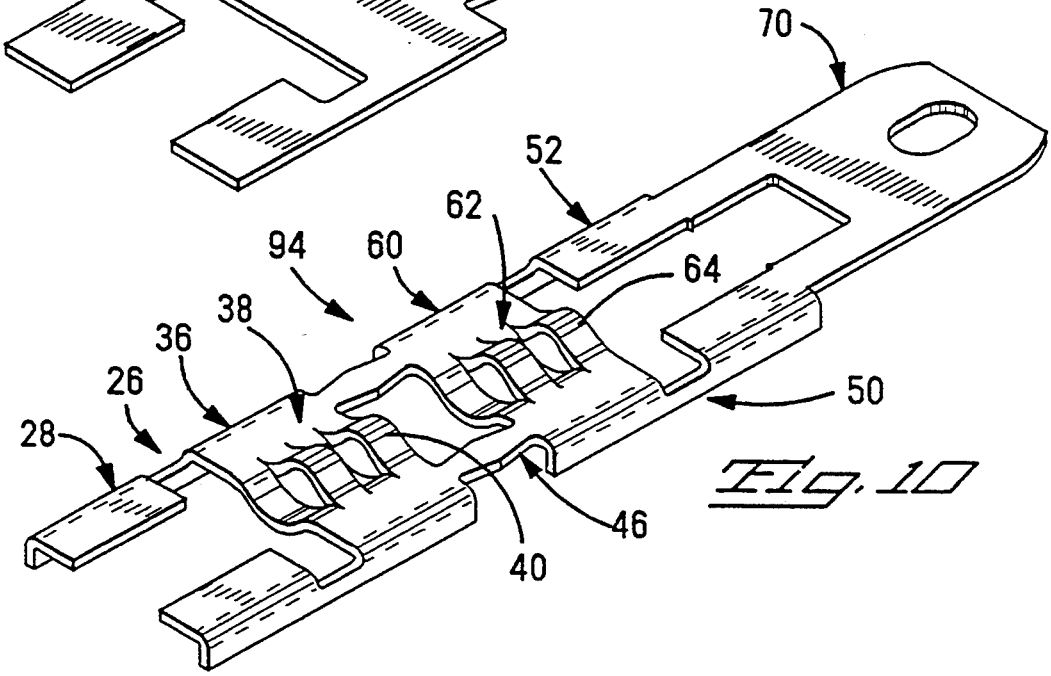
FIG. 10 is an isometric view of the formed blank of the terminal assembly of FIG. 9.
Figure 11:
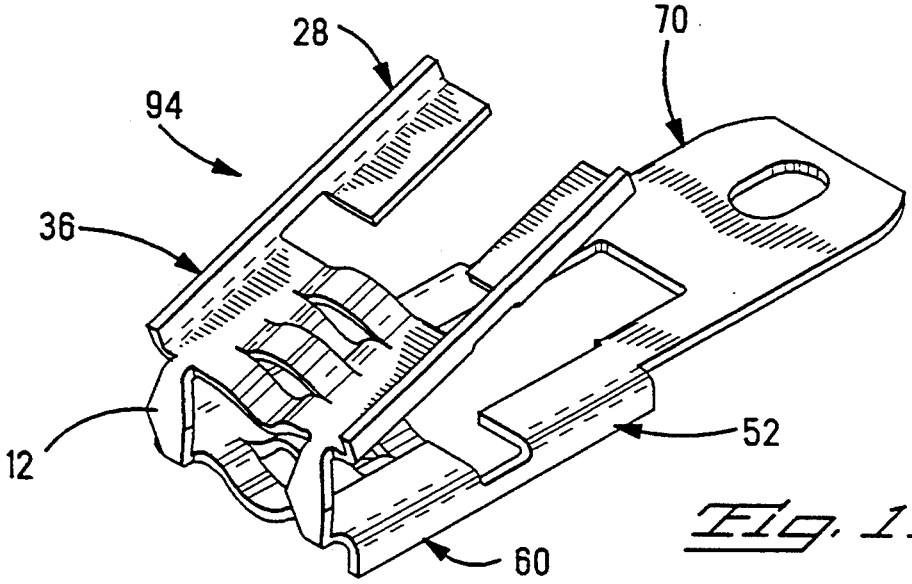
FIG. 11 is an isometric view of the terminal assembly of FIG. 9 after bending at the hinge joint.
Figure 12:
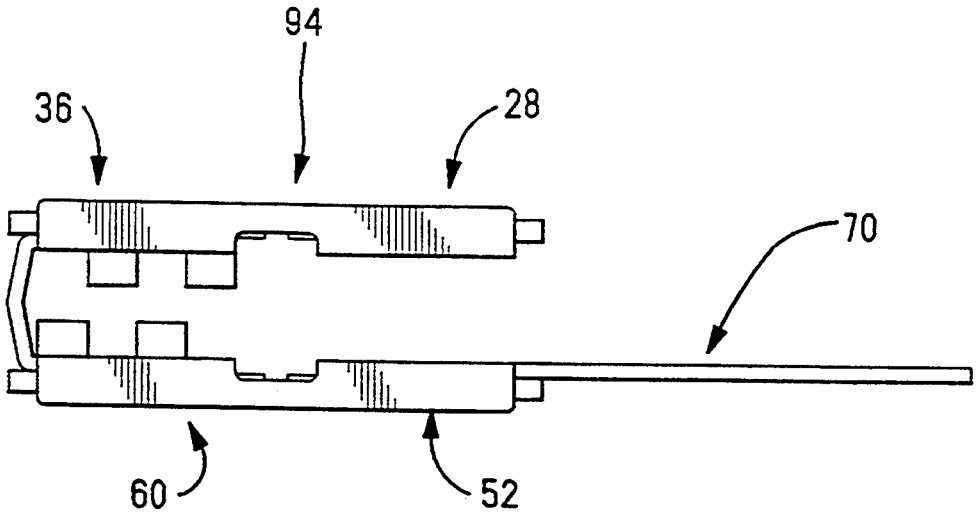
FIG. 12 is a side view of the terminal assembly of FIG. 11 prior to insertion of the cable.
Figure 13:
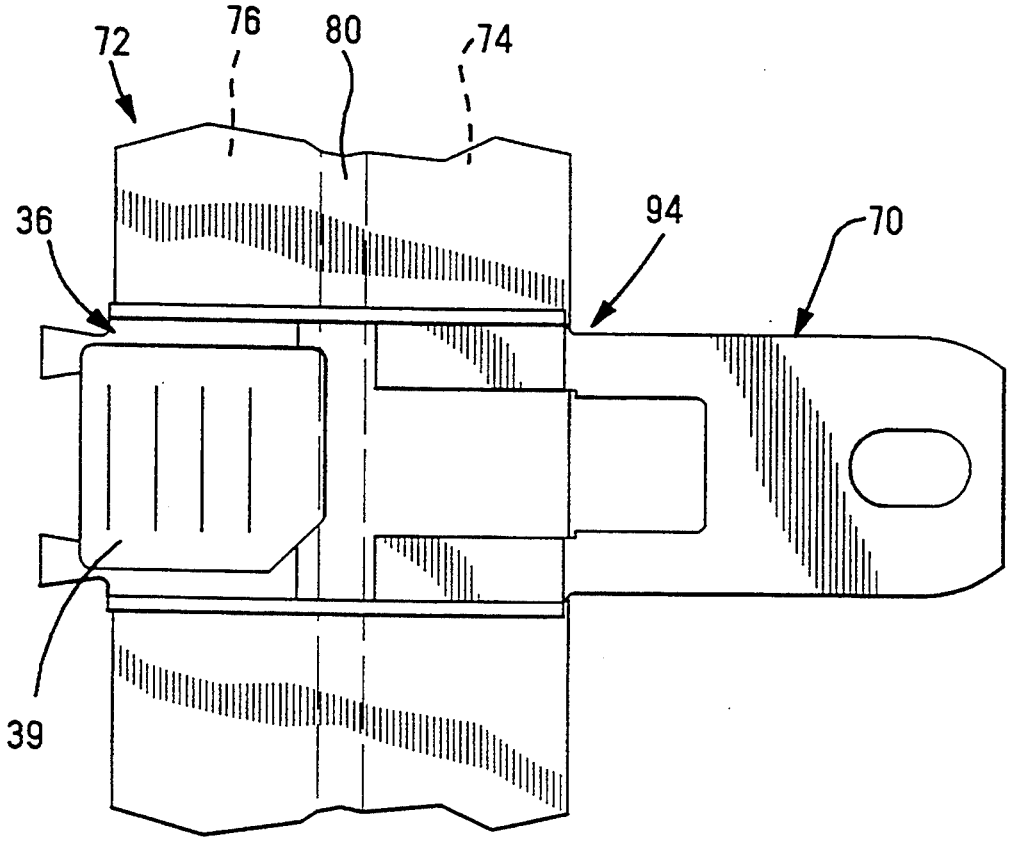
FIG. 13 is a plan view of the terminal embodiment of FIG. 11 terminated to the other conductor of a dual conductor cable.

Referring now to FIGS. 9 through 13, a second embodiment 94 of the present invention is adapted for terminating to the hinge proximate conductor 76 of a dual-conductor cable 72. FIG. 9 shows an alternative method for making the terminal assembly of the present invention in which a flat member is stamped from a strip of material and the flat blank is then formed such that the corresponding terminating regions of the assembly are removed prior to forming the side walls 44, 66 and the shearing portions 40, 64 of the selected terminating sections 36, 60. In the embodiment shown in FIGS. 9 through 13 the second portions 36, 62 of the upper and lower plate sections 26, 50 are formed into the shearing means 40, 64. Upon bending the first and second plate portions 26, 50 at hinged portion 46 the respective second portions 36, 60 lie in opposed relationship such that upon inserting a cable therebetween and pressing the two plate sections together, the hinge proximate conductor 76 is terminated to the assembly 94 thus interconnecting contact member 70 to the hinge proximate conductor 76.

Figure 14:
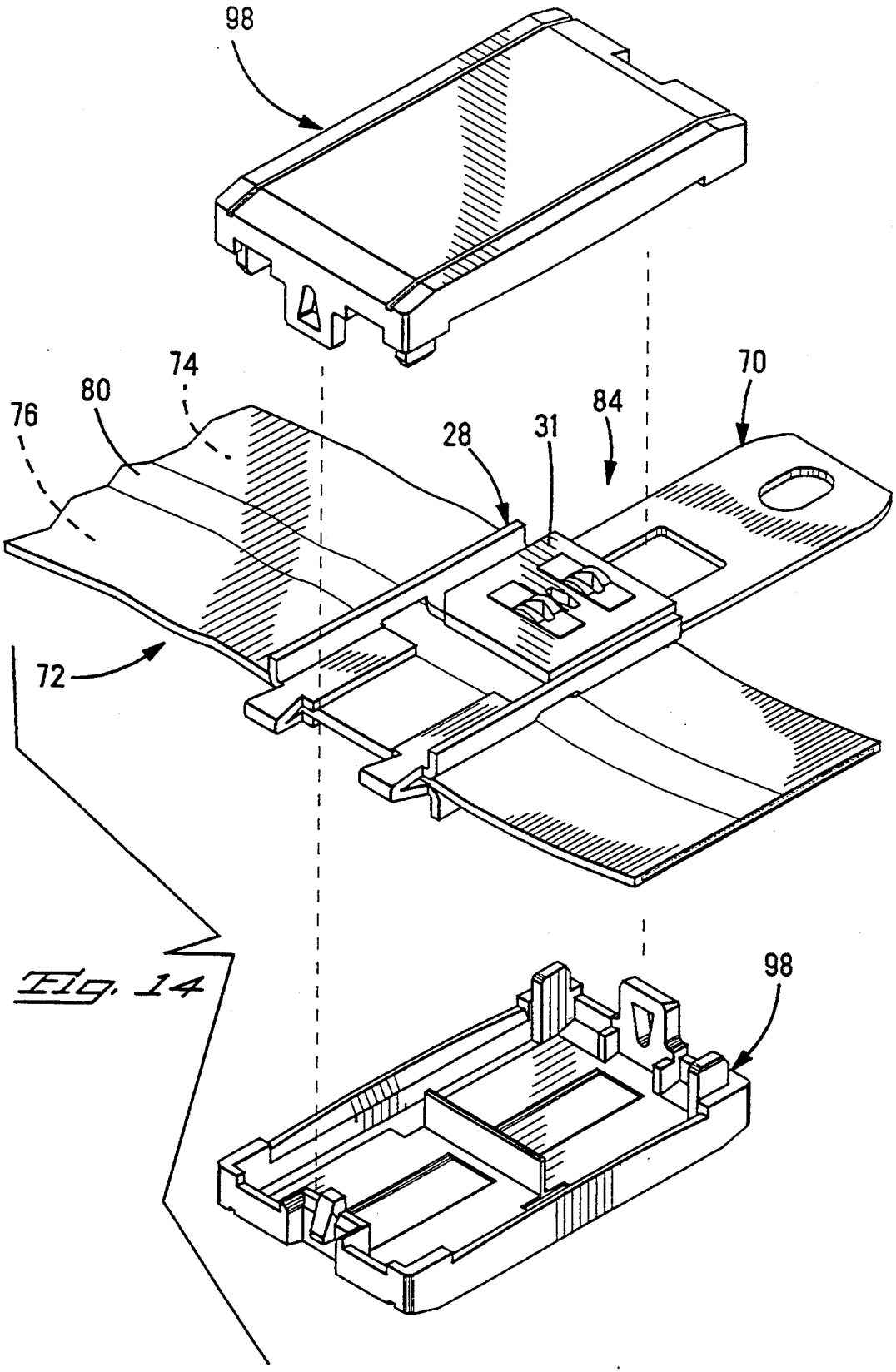
FIG. 14 is an isometric view of a representative terminal assembly of one embodiment of the present invention applied to a selected conductor of a flat dual-conductor cable and representative housing covers to be applied therearound.
Figure 15:
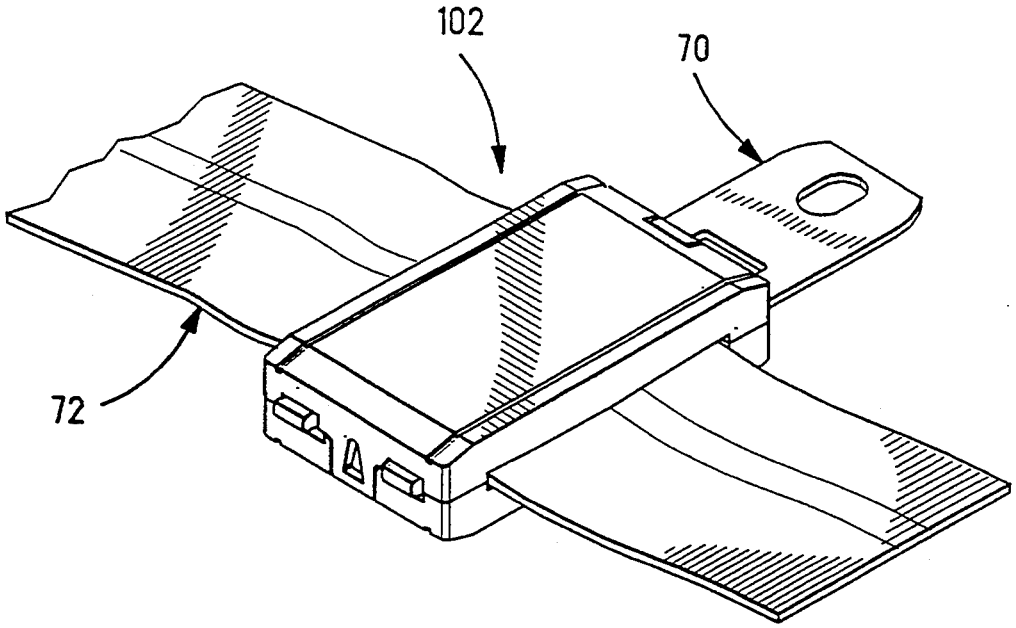
FIG. 15 is a view similar to that of FIG. 14 showing the assembled housing covers on the cable.

FIGS. 14 and 15 illustrate the embodiment 102 wherein the terminal assembly 84 is enclosed within housing covers 98 to form an insulated connection. FIG. 14 further shows more clearly the insert 31 used in terminating the assembly to the cable remote conductor 74.

Figure 16:
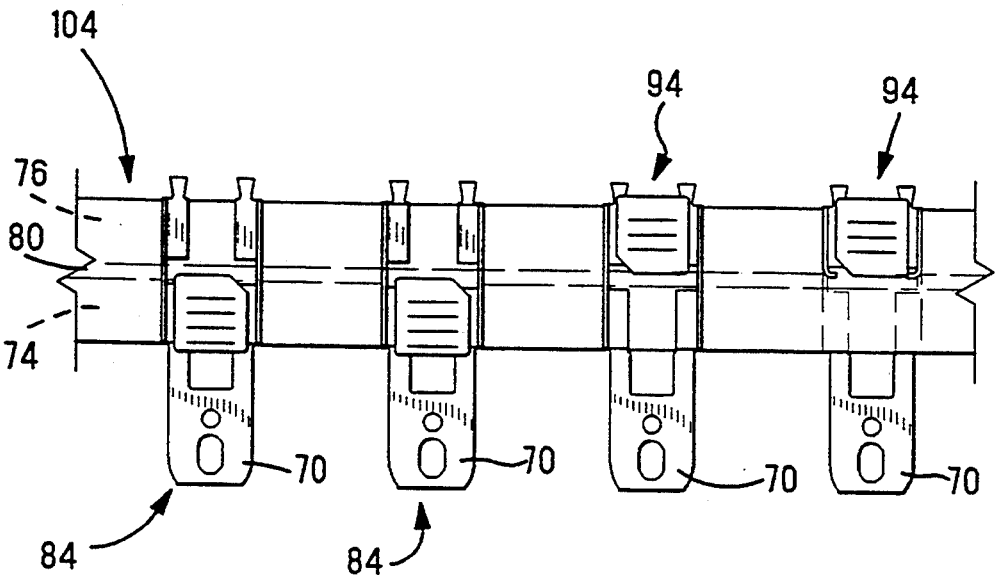
FIG. 16 is a dual-conductor bus bar having two terminal assemblies of one embodiment of the present invention terminated to one of the conductors of the cable and two assemblies of an other embodiment of the present invention terminated to the other conductor of the invention.

FIG. 16 shows a bus bar assembly 104 for having two of the terminal assemblies 84 terminated to the remote conductor 74 and two of assembly 94 attached to the cable proximate conductor 76. As can be seen in FIG. 16 all of the contact portions 70 extend along the same edge of bus bar assembly 104. Conductors 74, 76 in bus bar assembly 104 can be of the same or different voltages enabling interconnection to devices such as circuit boards or the like requiring different voltages, as well as the positive and ground of a power supply, for example. The present invention offers a distinct advantage over the conductor of the prior art in that there is no need to provide or use further tooling to sever the ligatures to isolate one or the other conductors and furthermore there is no need to rotate the assembly 180° to attach the assembly to a different conductor.

Figure 17:
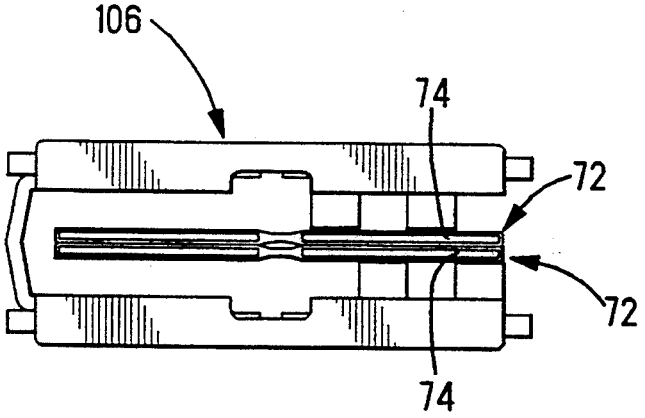
FIG. 17 is a side view of a further embodiment of the present invention illustrating a tap connector interconnecting corresponding conductors of two dual-conductor cables.
Figure 18:
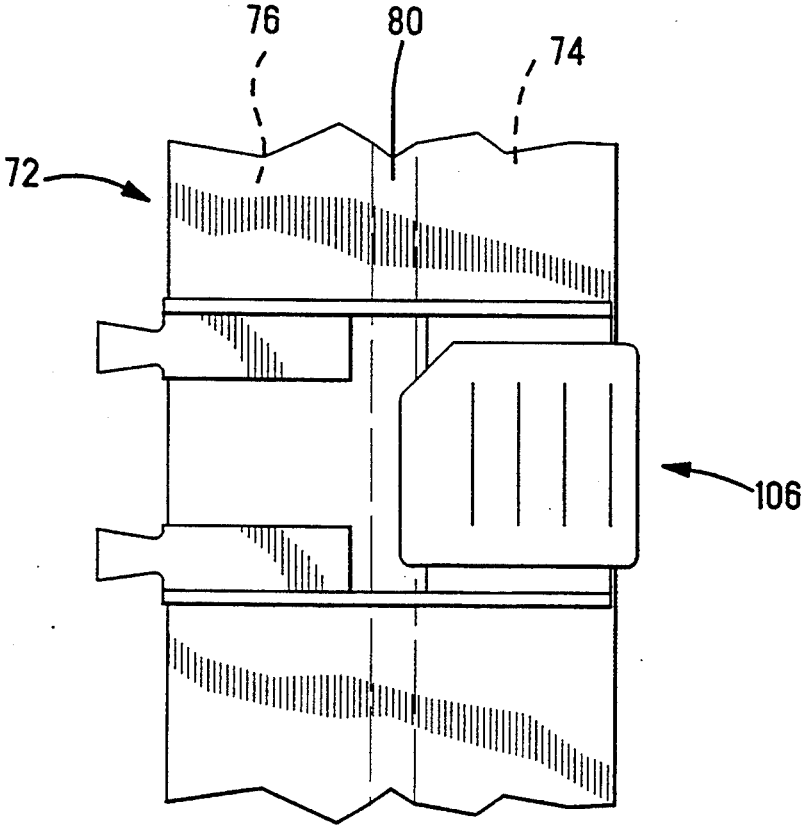
FIG. 18 is a plan view of the embodiment of FIG. 17 terminated to the cable.

FIGS. 17 and 18 show a further embodiment 106 of the present invention wherein the terminal assembly is used as a tap connector to electrically interconnect corresponding conductors of two or more cables. As shown in these Figures, the first section termination regions 30, and 54 remain in the assembly, while the second terminating regions 38, 54 have been removed. Upon applying pressure and terminating the assembly 106 to the cable the hinge remote conductor 74 of the two cables are electrically interconnected while keeping the hinge proximate conductors 76 electrically isolated from one another.

It is thought that the terminal assembly of the present invention and many of its attendant advantages will be understood from the foregoing description. It is apparent that various changes may be made in the form, construction, and arrangement of the parts thereof without the party from the spirit or scope of the invention or sacrificing all of its material advantages.

We claim:

1. A terminal assembly for terminating an intermediate portion of a selected conductor of a flat power cable having at least two insulated conductors, each conductor being spaced from an adjacent conductor by an insulating section, said assembly comprising:

at least a cable-proximate terminal body member which is integral at least initially and includes opposing upper and lower plate sections extending from a common bendable hinge, said upper and lower plate sections being initially spaced apart to receive a portion of continuous length of at least one flat cable between facing cable-proximate surfaces thereof transversely with respect to said upper and lower plate sections, and said upper and lower plate sections being at least translatable toward each other;

each of said upper and said lower plate sections having at least a first portion corresponding to a first conductor of said at least cable and a second portion associated with a second conductor of said at least one cable, said first and second portions separated by a transverse aperture associated with said insulated section between said first and second conductors, and extending from said cable-proximate surfaces to cable-remote surfaces of said upper and lower plate sections, and each of said upper and said lower plate sections having opposing side wall sections extending outwardly substantially perpendicularly from said cable-proximate surfaces and away from said cable-receiving region, with said opposing side wall sections bounding said aperture and at least initially joining said first and second portions, each of said at least first and second portions at least initially including conductor terminating regions intermediate said sidewalls; and one said terminating region of a selected one of said first and second portions of said upper and lower plate sections corresponding to a selected conductor of each said at least one cable, containing respective arrays of shearing means adapted to penetrate the selected conductor of the cable portion inserted therebetween upon said upper and lower plate sections being pressed together to shear the insulation and conductor of said at least one cable therebetween and define sheared conductor strips and extrude said strips outwardly of a plane of said conductor strips for electrical engagement with side edges of adjacent ones of said shearing means for electrical connection therewith, and said terminating regions of others of said first and second portions corresponding to the remaining conductors of said cable being severed from said assembly, whereby upon inserting said at least one cable between said upper and lower plate sections and pressing said plate sections together, said shearing means of a said selected terminating region shear the insulation of said selected conductor for electrical connection therewith and said remaining conductors remain electrical isolated from said terminated conductor.

2. The terminal assembly of claim 1 wherein said selected one of said first and second portions is adjacent said hinge.

3. The terminal assembly of claim 1 wherein said selected one of said first and second portions is remote from said hinge.

4. The terminal assembly of claim 1 wherein a contact section extends from an end of one of said upper and lower plates remote from said hinge.

5. The terminal assembly of claim 1 where in said assembly has inserts added to said terminating region along cable remote surfaces of said upper and lower plate sections.

6. A method for making a terminal assembly for terminating an intermediate portion of a selected conductor of a flat power cable having at least two insulated conductors, each conductor being spaced from an adjacent conductor by an insulating section, said method comprising the steps of:

providing at least a cable-proximate terminal body member which is integral at least initially and includes opposing upper and lower plate sections extending from a common bendable hinge, said upper and lower plate sections being initially spaced apart to receive a portion of continuous length of at least one flat cable between facing cable-proximate surfaces thereof transversely with respect to said upper and lower plate sections, and said upper and lower plate sections being at least translatable toward each other, each of said upper and said lower plate sections having at least a first portion corresponding to a first conductor of said at least cable and a second portion associated with a second conductor of said at least one cable, said first and second portions separated by a transverse aperture associated with said insulated section between said first and second conductors, and extending from said cable-proximate surfaces to cable-remote surfaces of said upper and lower plate sections, and each of said upper and lower plate sections having opposing side wall sections extending outwardly substantially perpendicular from said cable-proximate surfaces and away from said cable-receiving region, with said opposing side wall sections bounding said aperture and at least initially joining said first and second portions, each of said at least first and second portions at least initially including conductor terminating regions intermediate said sidewalls;

providing respective arrays of shearing means to one of said terminating regions of a selected one of said first and second portions of said upper and lower plate sections corresponding to a selected conductor of each said at least one cable, said respective arrays of shearing means adapted to penetrate the selected conductor of the cable portion inserted therebetween upon said upper and lower plate sections being pressed together to shear the insulation and conductor of said at least one cable therebetween and define sheared conductor strips and extrude said strips outwardly of a plane of said conductor strips for electrical engagement with side edges of adjacent ones of said shearing means for electrical connection therewith; and severing said terminating regions of others of said first and second portions corresponding to the remaining conductors of said cable, whereby upon inserting said at least one cable between said upper and lower plate sections and pressing said plate sections together, said shearing means of a said selected terminating region shear the insulation of said selected conductor for electrical connection therewith and said remaining conductors remain electrical isolated from said terminated conductor.

7. The method of claim 6 wherein said severed terminating region of said others of said first and second portions is adjacent said hinge.

8. The method of claim 6 wherein said severed terminating region of said others of said first and second portions is remote from said hinge.

9. The method of claim 6 further including providing said terminal body with a contact section extends from an end of one of said upper and lower plates remote from said hinge.

10. The method of claim 6 further including providing said assembly with inserts to be added to said terminating region along cable remote surfaces of said upper and lower plate sections.

* * * * *